United States Patent [19]

Strahm

[11] 4,044,590

[45] Aug. 30, 1977

[54] DENTED ARTICLE SMOOTHING AND SHRINKING ARRANGEMENT

[75] Inventor: Anton Strahm, Oberweier, Germany

[73] Assignee: Robert Brendle & Cie., France

[21] Appl. No.: 675,241

[22] Filed: Apr. 8, 1976

[30] Foreign Application Priority Data

Apr. 8, 1975 Germany ..... 2515296

[51] Int. Cl.[2] ..... B21D 1/06

[52] U.S. Cl. ..... 72/342; 148/130

[58] Field of Search ..... 72/342; 148/130, 150; 219/234

[56] References Cited

U.S. PATENT DOCUMENTS

| | | | |
|---|---|---|---|
| 2,227,476 | 1/1941 | Williams et al. | 72/342 |
| 3,352,724 | 11/1967 | McNitt et al. | 148/150 |
| 3,769,102 | 10/1973 | Godin et al. | 148/130 |

FOREIGN PATENT DOCUMENTS

| | | | |
|---|---|---|---|
| 1,162,315 | 2/1964 | Germany | 72/342 |

*Primary Examiner*—Lowell A. Larson

*Attorney, Agent, or Firm*—Craig & Antonelli

[57] ABSTRACT

A smoothing and shrinking arrangement for dented articles such as plates or the like, which arrangement includes an electrode connected to one pole of a voltage source, the other pole of which is connected to the plate being worked. A shielding element surrounds the electrode with a cooling construction being provided at the electrode for cooling at least a region of the plate affected by the electrode.

29 Claims, 2 Drawing Figures

DENTED ARTICLE SMOOTHING AND SHRINKING ARRANGEMENT

BACKGROUND OF THE INVENTION

Figure 1:
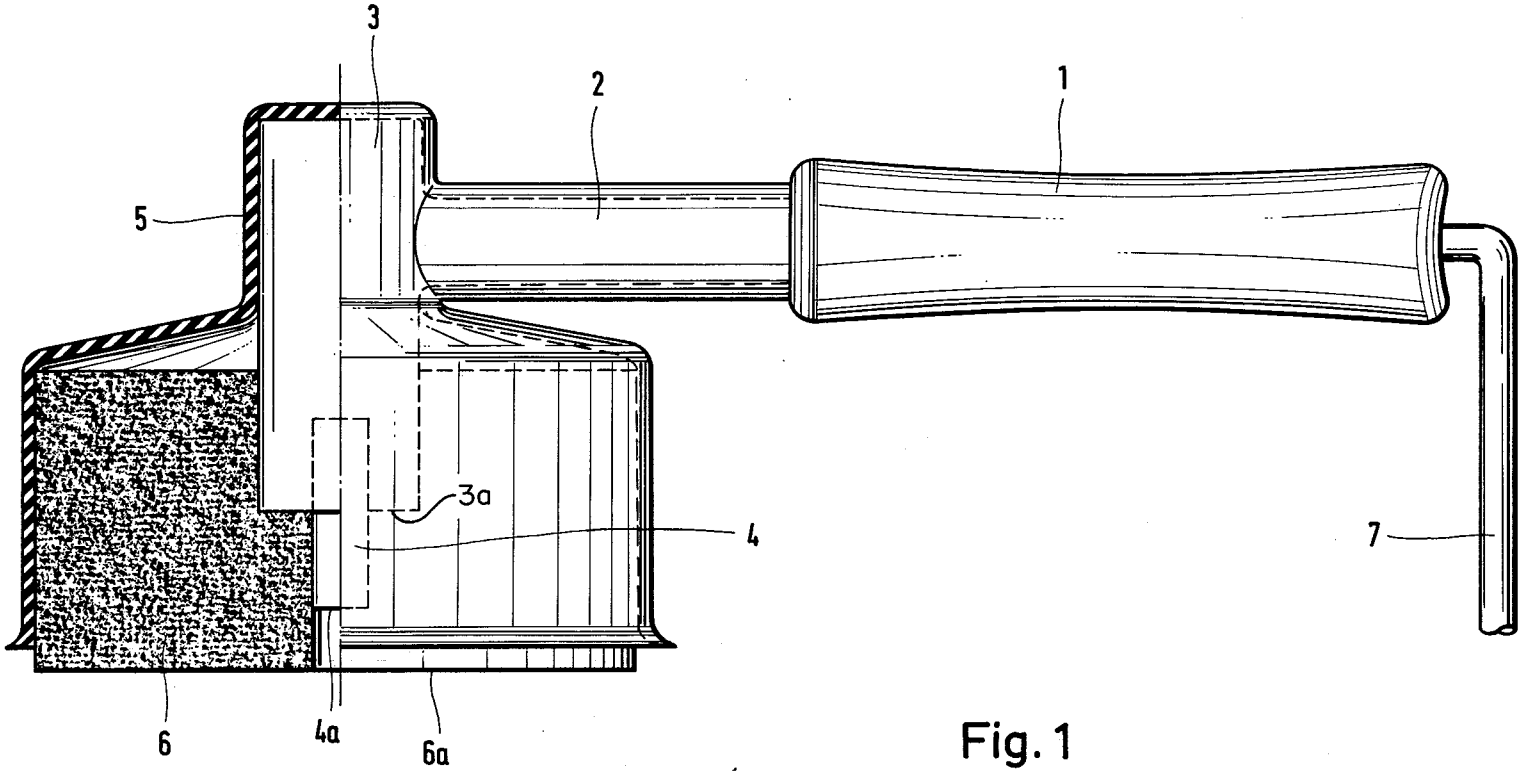

The present invention relates to a dent removal arrangement, and more particularly, to an arrangement for smoothing and shrinking dented plates or the like by way of an electrode, fitted to a handle in the manner of a hammer, connected to one pole of a voltage source, the other pole of which is connected to the plate to be worked, with the electrode being surrounded by a coaxially disposed cylindrical shield or anti-dazzle device.

A dent removal device of the electrode-type has been described, for example, in German Offenlegungsschrift No. 2,362,103, wherein electrical joulean heat is employed for a brief local heating of the sections or parts of the plate to be worked or re-shaped. Generally, in the reworking of s dented plate, the indentations are first pressed out with a conventional dent removal tool and then the uneven parts which still remain are subjected to a grinding operation to clean the same, thereby improving the electrical conductivity of the plate. The thus processed denoted plate is then connected to one pole of a voltage source, for example, a welding transformer with an output of approximately 50 volts, with the other pole of the voltage source being connected to the electrode-type dent removal device. Upon a touching of the dented plate with the electrode, the circuit is closed and the plate is strongly heated for a split second during the contact period. During a subsequent cooling period, the plate is re-shaped to conform to its initial state. By repeatedly touching the plate with the electrode or by sliding the electrode over the plate, the dented plate can gradually be re-shaped to the smooth surface of its initial state.

One advantage of the electrode-type dent removal arrangement over a dent removal by way of an oxy-acetylene welding arrangement resides in the fact that, in the former arrangement, only a brief local heating occurs. Therefore, inner linings, cable linings and the like disposed in proximity to or protected by the plate being worked or re-shaped are protected from damage resulting from an overall heating of the plate. Consequently, the linings, cable lines and the like need not be removed during the repair of the dented plate.

A further advantage of the electrode-type dent removal arrangement resides in the fact that the plate sections or parts being treated are fairly free from stresses after working, so that the stability of the repaired plate part is maintained.

One disadvantage of the conventional electrode-type dent removal arrangement of the afore-mentioned type resides in the fact that, in the repair of large or difficult plate areas, it is necessary to include in the dent removing process cooling pauses throughout because it is necessary first to wait for the plate to re-shape gradually during cooling to ascertain the respective state of the reformation and, second, without a cooling pause, the neighboring parts such as the inner linings, cables and the like, gradually become hot, thereby subjecting these parts to possible damage. Furthermore, the quality of the dent removal process falls significantly with increasing temperatures.

It has been proposed to reduce the working voltage and/or current to thereby delay the gradual heating of the plate; however, such proposals have only had partial success since such proposals result in the overall dent-removing process time increasing disproportionately. Therefore, in the conventional electrode-type dent removal arrangements, it may be necessary to wipe the heated plate parts or sections from time to time with, for example, a wet cloth or the like.

The aim underlying the present invention essentially resides in providing an arrangement for smoothing and shrinking dented elements, whereby the plate re-working process may be carried out most conveniently by providing a cooling of the surrounding plate parts simultaneously with the touching or contacting of the electrodes and the plate, and also by the local heating of an uneven area. By virtue of such an arrangement, the working progress attained is immediately fixed and smoothing can readily be continued without any interruption in the work, since the operating personnel are able to ascertain the effect of the plate smoothing practically immediately after each touching or stroking of the plate with the electrode.

According to the present invention, an electrode-type arrangement for smoothing and shrinking a dented plate is provided with the electrode being fitted to a handle in the manner of a hammer, and with the electrode being connectable to one pole of a voltage source, the other pole of which is connectable to the plate to be worked. Furthermore, the electrode is surrounded by a coaxial disposed, preferably, a cylindrical shield or anti-dazzle device which may be combined with a cooling element for at least cooling the region of the plate part to be worked.

One advantage of combining the electrode with the cooling element resides in the fact that the electrode material is heated to a lesser extent and is, therefore, subjected to less wear. Also, a better surface quality of the worked surface part is obtainable.

According to one advantageous feature of the present invention, the shield or anti-dazzle device is in the form of a cylindrical container and functions simultaneously as a casing or housing for accommodating a cooling element.

According to one embodiment of the present invention, the cooling element itself is preferably an annular sponge held in an annular space provided between the electrode and the shield of anti-dazzle device, with the other end surface of the sponge being aligned with or projecting beyond the working surface of the electrode. By virtue of this construction, the dent removal device need only be dipped into water or other cooling fluid at the beginning of the working, so that the water or other fluid is absorbed into the sponge. Upon the touching or sliding of the electrode over the dented plate, the vicinity of the area on the plate contacted by the electrode is wetted with the cooling liquid so that even with a large working area, there is no unduly great heating of the entire plate.

According to another particularly advantageous feature of the invention, the sponge element may project beyond the electrode working surface so that the elastic resilience of the sponge allows only brief contact between the electrode and the plate being worked, while a good cooling of the neighboring zones is insured as the overlying sponge is, to some extent, squeezed and, therefore, makes sufficient cooling liquid available.

According to still yet another advantageous feature of the present invention, the shielding or anti-dazzle device is preferably made of an elastic material with the other edge thereof being approximately aligned with the electrode working surface. By virtue of this construction, no damage can occur during the touching or sliding of the electrode, and the shielding or anti-dazzle device lies firmly on the plate, thereby preventing unnecessary cooling liquid losses.

In a further embodiment of the present invention, the cooling is realized by providing a compressed air line which may open into an annular space between the electrode and the shield or anti-dazzle device. To enhance the cooling effect of a construction of this type, the compressed air may be fed through several holes distributed about the electrode in the immediately vicinity thereof. The presence of the shield or anti-dazzle device maintains the cooling air in the region of the electrode, so that even with small quantities of cooling air, a good cooling effect is nevertheless obtained.

In accordance with a further feature of the present invention, rather than supply compressed air, a cooling fluid such as, for example, water, may be directed into the annular space between the electrode and the shield. If desired, several holes may be distributed about the electrode in order to more effectively feed the cooling liquid to the immediate vicinity of the electrode.

Preferably, in accordance with the present invention, the electrode may be of the form of a replaceable copper cotton pin which is locked in a cylindrical support which is slightly set back. This construction is desirable since the shape of the plate indentations normally are considerably varied. By providing an electrode mounted in this manner, the operation can therefor be carried out with different electrode shapes and worn electrodes can be easily replaced. The support for the cotter pin forming the electrode may be provided with a flat end surface which also may function as an electrode if the cotter pin is removed.

Accordingly, it is an object of the present invention to provide an electrode-type dent removal arrangement which avoids, by simple means, the afore-mentioned shortcomings and drawbacks encountered in the prior art.

Another object of the present invention resides in providing an improved electrode-type dent removing arrangement which permits the re-working process of a dented plate to be continued without any interruption.

A further object of the present invention resides in providing an electrode-type dent arrangement, wherein the electrode material is subjected to less wear.

Still another object of the present invention resides in providing an improved electrode-type dent removing arrangement which permits a better surface quality of the worked surface part than obtainable by prior art constructions.

A still further object of the present invention resides in providing electrode-type dent removing arrangement which is combined with a cooling construction for cooling at least the region of the plate part to be worked.

Figure 2:
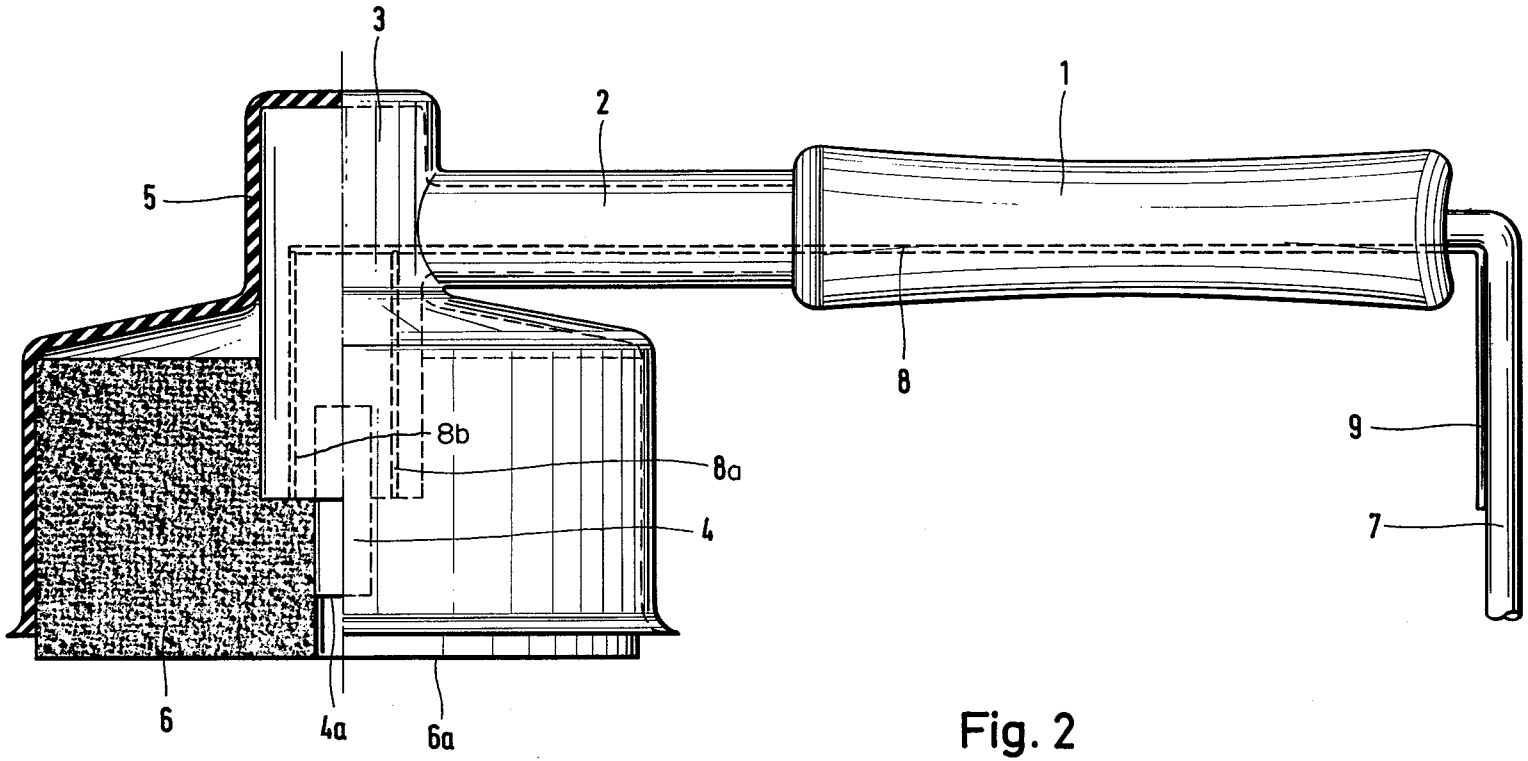

These and other objects, features and advantages of the present invention will become more apparent from the following description when taken in connection with the accompanying drawing which shows, for the purposes of illustration only, two embodiments of a dent removing arrangement in accordance with the present invention, and wherein:

FIG. 1 is a side view, partially in cross-section, of a first embodiment of a dent removing arrangement in accordance with the present invention; and FIG. 2 is a side view, partially in cross-section, of a second embodiment of a dent removing arrangement in accordance with the present invention.

Referring now to the drawings, wherein like reference numerals are used throughout the various views to designate like parts, and more particularly, to FIG. 1, according to this figure, electrode holder 3 is fixed to a handle 1 by way of a shank 2 in the manner similar to a hammer, with the handle 1, shank 2 and electrode holder 3 all being provided with an insulating covering. Electrode 4 is disposed in the electrode holder 3 and is, preferably, in the form of a replaceable, cylindrically-shaped, copper cotter pin which is locked in a central bore of the electrode holder 3.

A shielding or anti-dazzle device 5 in the form of a casing or housing is fixed to the electrode holder 3 and is disposed so as to be concentric with the electrode holder 3 and the electrode 4. The shielding device 5 accommodates and embraces a sponge-like member 6 having an annular shape with the sponge being held in an interspace provided between the electrode holder 3, electrode 4 and the casing 5. The sponge-like member is so dimensioned that its outer annular surface 6*a* projects beyond the working surface 4*a* of the electrode and, by lightly pressing against a dented plate to be worked, the sponge-like member yields or gives to such an extent that the electrode 4 comes into electrical contact with the plate being worked. Preferably, the casing 5 is of a rubber-like flexible material so that by simply squeezing the casing, the delivery of the cooling fluid from the sponge 6 can be accelerated.

By arranging the sponge in the direct vicinity of the electrode 4 and the casing 5, the electrode 4 is at the same time protected so that no unintentional contact between the electrode 4 and an exposed metal surface can occur, thereby causing short circuiting. Moreover, by virtue of the presence of the casing 5, the user of the dent removal device is shielded from the light flashes between the electrode 4 and the plate which normally occurs during a working of the dented plate.

If a larger electrode working surface is required, in accordance with the present invention, it is possible to withdraw the electrode 4 and instead use the bottom end surface 3*a* of the electrode holder as the electrode. In this case, either the sponge-like member 6 must be pressed somewhat deeper into the casing 5 or a somewhat flater sponge must be employed.

Electricity is supplied to the electrode holder 3 and the electrode 4 through a connecting line 7 which enters at the handle end of the dent removal device. The connecting line 7 is suitably connected to one pole of a voltage source (not shown) with the other pole of the voltage source being connected to the plate being worked. Preferably, the working voltage is about 42–52 volts and the current is about 60–90 amps and, in the case of an aluminum plate or the like, the current is about 120 amps. Thus, commerically available welding transformers may readily be utilized for operating the dent removal arrangement of the present invention.

As shown in FIG. 2, a cooling line 8 may be provided which extends through handle 1, shank 2 and electrode holder 3 with one end of the cooling line being connected by way of a hose 9 or the like to a source of cooling fluid (not shown) and the other end of the cooling line terminating in the electrode holder at a position in close proximity to the electrode 4. While FIG. 2 illustrates the cooling line 8 as terminating in two cooling bores or channels 8*a*, 8*b*, it is understood that the cooling line 8 may terminate in either a single cooling bore or in three or more cooling bores or channels positioned about the periphery of the electrode 4. As is apparent from FIG. 2, cooling fluid such as cooling air or cooling water is supplied through the hose 9 and cooling line 8 into the area surrounding the electrode. To facilitate handling of the dent removing arrangement, the hose 9 may be coupled by a suitable coupling (not shown) to the connecting line 7.

By providing a dent removing arrangement in accordance with the present invention, wherein the electrode-type dent removing device is combined with a cooling element, extensive dent removal work can be carried out on an article without pauses for cooling and, since the cooling automatically proceeds with the working of the article, the handling of the dent removing arrangement is considerably simplified, as the user is able to immediately take into account the actual working progress attained. Furthermore, the construction of the present invention results in a compact dent removing arrangement which may readily be produced at low cost.

While I have shown and described two embodiments in accordance with the present invention, it is understood that the same is not limited thereto, but is susceptible of numerous changes and modifications as known to a person skilled in the art, and I therefore do not wish to be limited to the details shown and described herein, but intend to cover all such changes and modifications as are encompassed by the scope of the appended claims.

I claim:

1. An arrangement for smoothing and shrinking a dented article, the arrangement comprising:

an electrode means for effecting a heating of at least a portion of the article, said electrode means including an end face for contacting the article, said electrode means and the dented article being connectable with a voltage source means;

a cooling means provided at said electrode means for cooling at least a portion of the article affected by said electrode means, said cooling means consisting of a means for selectively impermanently taking up a cooling fluid having an outer end surface which is aligned with said end face of said electrode means; and a shield means mounted at said electrode means so as to be coaxial therewith for shielding the electrode means, said shield means including a cylindrical casing means for accommodating said cooling means, said cylindrical casing means defining an annular space between said electrode means and said casing means with said cooling means being accommodated in said annular space.

2. An arrangement according to claim 1, further comprising a handle means, means for mounting said electrode means on said handle means, said handle means and said mounting means being arranged such that the electrode means is fitted to the handle means in the manner of a hammer.

3. An arrangement according to claim 1, wherein said casing means is formed of an elastic material and includes an outer edge aligned with said end face of said electrode means.

4. An arrangement according to claim 1, wherein an annular space is provided between said electrode means and said casing means, and wherein means are provided for directing a flow of a cooling fluid into said annular space.

5. An arrangement according to claim 4, wherein a cooling fluid directed into said annular space, said cooling fluid consisting of compressed air.

6. An arrangement according to claim 5, wherein said electrode means includes a replaceable pin means and a means for mounting said pin means slightly set back in said casing means.

7. An arrangement according to claim 6, wherein said mounting means includes a cylindrical support having a central bore means for receiving said pin means.

8. An arrangement according to claim 7, wherein said pin means is a copper cotter pin.

9. An arrangement according to claim 6, wherein said mounting means includes a flat end surface useable as an electrode if said pin means is removed.

10. An arrangement according to claim 4, wherein a cooling fluid is directed into said annular space, said cooling fluid consisting of cooling water.

11. An arrangement according to claim 10, wherein said electrode means includes a replaceable pin means and a means for mounting said pin means slightly set back in said casing means.

12. An arrangement according to claim 11, wherein said mounting means includes a cylindrical support having a central bore means for receiving said pin means.

13. An arrangement according to claim 12, wherein said pin means is a copper cotter pin.

14. An arrangement according to claim 11, wherein said mounting means includes a flat end surface useable as an electrode if said pin means is removed.

15. An arrangement according to claim 1, wherein said means for selectively impermanently taking up a cooling fluid consists of a porous member.

16. An arrangement according to claim 15, wherein said porous member is a sponge.

17. An arrangement for smoothing and shrinking a dented article, the arrangement comprising:

an electrode means for effecting a heating of at least a portion of the article, said electrode means including an end face for contacting the article, said electrode means and the dented article being connectable with a voltage source means;

a cooling means provided at said electrode means for cooling at least a portion of the article affected by said electrode means, said cooling means consisting of a means for selectively impermanently taking up a cooling fluid having an outer end surface which projects beyond the end face of said electrode means; and a shield means mounted at said electrode means so as to be coaxial therewith for shielding the electrode means, said shield means including a cylindrical casing means for accommodating said cooling means, said cylindrical casing means defining an annular space between said electrode means and said casing means with said cooling means being accommodated in said annular space.

18. An arrangement according to claim 17, wherein said casing means is formed of an elastic material and includes an outer edge approximately aligned with said end face of said electrode means.

19. An arrangement according to claim 18, wherein said means for selectively impermanently taking up a cooling fluid consists of an annular porous member.

20. An arrangement according to claim 19, wherein said porous member is a sponge.

21. An arrangement according to claim 17, wherein said cooling means includes means for directing a flow of cooling fluid into said casing means.

22. An arrangement according to claim 21, wherein said cooling fluid directing means includes at least one cooling fluid bore provided in said casing means terminating in a vicinity of said electrode means and communicating therewith.

23. An arrangement according to claim 22, wherein a cooling fluid is directed into said casing means, said cooling fluid consisting of compressed air.

24. An arrangement according to claim 22, wherein a cooling fluid is directed into said annular space, said cooling fluid consisting of cooling water.

25. An arrangement according to claim 17, wherein said electrode means is rigidly attached to a handle means, and wherein said means for selectively impermanently taking up a cooling fluid includes an annular sponge surrounding said electrode means, an outer end surface of the annular sponge projecting beyond the end face of the electrode means and beyond an end surface of said casing means.

26. An arrangement according to claim 25, wherein said casing means is formed of an elastic material and includes an outer edge approximately aligned with said end face of said electrode means.

27. An arrangement according to claim 26, wherein said electrode means includes a replaceable pin means and a means for mounting said pin means slightly set back in said casing means.

28. An arrangement according to claim 27, wherein said mounting means includes a cylindrical support having a central bore means for receiving said pin means.

29. An arrangement according to claim 28, wherein said mounting means includes a flat end surface useable as an electrode if said pin means is removed.

* * * * *